US005120405A

United States Patent [19]

Ito et al.

[11] Patent Number: 5,120,405

[45] Date of Patent: Jun. 9, 1992

[54] METHOD OF COLORING ALUMINUM OR ALUMINUM ALLOY MATERIAL

[75] Inventors: Seishiro Ito, Ikoma; Hideo Fukui, Kurobe; Norio Nakada; Hatsuo Hirono, both of Toyama, all of Japan

[73] Assignee: Yoshida Kogyo K.K., Tokyo, Japan

[21] Appl. No.: 663,009

[22] Filed: Mar. 1, 1991

[30] Foreign Application Priority Data

Mar. 2, 1990 [JP] Japan ..... 2-49492

[51] Int. Cl.[5] ..... C25D 5/44; C25D 13/02; C25D 11/24

[52] U.S. Cl. ..... 205/202; 204/181.2

[58] Field of Search ..... 204/181.2, 37.6, 42

[56] References Cited

U.S. PATENT DOCUMENTS

| | | | |
|---|---|---|---|
| 3,031,387 | 4/1962 | Deal | 204/58 |
| 3,143,435 | 8/1964 | Kampert | 427/67 |
| 3,718,548 | 2/1973 | Paulet et al. | 204/37.6 |
| 3,844,908 | 10/1974 | Matsuo et al. | 204/37.6 |
| 4,659,439 | 4/1987 | Watanabe et al. | 204/37.6 |

FOREIGN PATENT DOCUMENTS

| | | |
|---|---|---|
| 38-1715 | 1/1963 | Japan . |
| 54-23661 | 3/1979 | Japan . |

*Primary Examiner*—John Niebling
*Assistant Examiner*—Kishor Mayekar
*Attorney, Agent, or Firm*—Hill, Van Santen, Steadman & Simpson

[57] ABSTRACT

An aluminum or aluminum alloy material is subjected to anodic oxidation, then to a treatment of electrophoresis in a bath containing a hexacyanoferrate (II) or hexacyanoferrate (III), and subsequently to a treatment of immersion in a bath containing at least one metal salt selected from the group consisting of salts of Fe, Ni, Co, Cu, Zn, Cd, Ba, Tl, and Mg and at least one electrolyte selected from the group consisting of sodium sulfate, potassium sulfate, sodium chloride, and potassium chloride. Consequently, a coloring compound formed by the reaction of the aforementioned hexacyanoferrate (II) or hexacyanoferrate (III) with the aforementioned metal salt is deposited in the receding parts of micropores of an anodic oxide coating, with the result that the aluminum or aluminum alloy material is endowed with a durable color.

6 Claims, 1 Drawing Sheet

METHOD OF COLORING ALUMINUM OR ALUMINUM ALLOY MATERIAL

BACKGROUND OF THE INVENTION

1. Field of the Invention

This invention relates to a method for the impartation of a durable primary color of blue, green, red, brown, white, etc. to the surface of an aluminum or aluminum alloy material (hereinafter referred to as "aluminum material").

2. Description of the Prior Art

As methods for the coloration of an aluminum material already treated for the formation of an anodic oxide coating thereon, various methods have been known to the art such as the so-called electrolytic coloring method which comprises immersing an anodized aluminum material in an electrolytic solution containing at least one metal salt selected from inorganic acid salts such as nitrates, sulfates, phosphates, hydrochlorides, chromates and organic acid salts such as oxalates, acetates, and tartrates of such metals as Ni, Co, Cr, Cu, Cd, Ti, Mn, Mo, Ca, Mg, V, Pb, and Zn, and subjecting the immersed aluminum material to the electrolysis with alternating current thereby causing a relevant metal, metal hydroxide, or metal oxide to be deposited within micropores in the anodic oxide coating and consequently imparting the corresponding color to the surface of the aluminum material [as disclosed in Japanese Patent Publication SHO 38(1963)-1,715 and SHO 54(1979)-23,661, for example]and the method which comprises combining a direct current, an alternating current, a waveform similar thereto, or a deformed waveform in the process of secondary electrolysis. Further, the so-called integral color anodizing method which comprises anodizing an aluminum material to form a colored anodic oxide coating on the aluminum material by virtue of the particular kind of an electrolytic solution or the action of the element to be incorporated in the aluminum material has been known to persons skilled in the art [as disclosed in U.S. Pat. No. 3,031,387, U.S. Pat. No. 3,143,485, etc.]. Besides the methods which resort to such electrochemical treatments as described above, the methods of immersion coloration using baths of inorganic compounds or organic dyes have been well known in the art.

By the electrochemical treatment such as for the electrolytic coloring or integral color anodizing mentioned above, it is not easy to impart a clear primary color to aluminum materials such as facing materials in buildings which have been furnished for the fulfilment of the quality of durability with an anodic oxide coating of a medium thickness (not less than 9 μm, for example). It is said that the anodic oxide coating entails a decline in the quality of practical durability when it is given a treatment for increasing their micropores in size and number by combining a direct current, an alternating current, a waveform similar thereto, a deformed waveform, or voltage in the process of secondary anodic oxidation intended to ensure impartation of a primary color.

In contrast, by the method of immersion coloration, it is not easy to impart a durable and clear color to the aluminum material because a coloring substance is predominantly deposited in the entrance parts of the micropores of the anodic oxide coating and, during the after-treatment as by washing with water, the deposited coloring substance is removed from the micropores to the extent of impairing the resistance to corrosion and resistance to light of the colored aluminum material.

SUMMARY OF THE INVENTION

An overall object of this invention, therefore, is to provide a method of coloring an aluminum material, which is capable of imparting a varying durable primary color to the surface of the aluminum material.

Another object of this invention is to provide a method of coloring an aluminum material, which is capable of imparting a durable clear color to the aluminum material in a relatively short period of time by causing a coloring compound to be deposited by a chemical reaction within micropores of an anodic oxide coating of the aluminum material.

Yet another object of this invention is to provide a method of coloring an aluminum material, which is capable of imparting the durable various colors to the aluminum material by causing a coloring compound to be deposited by a chemical reaction within micropores of a colored anodic oxide coating of the aluminum material.

Still another object of this invention is to provide a method of coloring an aluminum material, which is capable of imparting a durable color with high operational efficiency to the surface of the aluminum material while obviating the necessity for subjecting an anodic oxide coating of the aluminum material to a modification treatment which is liable to impair the quality of durability of the coating as by enlarging or deforming the micropores in the anodic oxide coating.

To accomplish the objects described above, in accordance with this invention, there is provided a method of coloring an aluminum material which comprises the steps of:

A) subjecting the aluminum material to anodic oxidation thereby forming an anodic oxide coating on the surface thereof, B) subjecting the anodized aluminum material to a treatment of electrophoresis in a bath containing hexacyanoferrate (II) or hexacyanoferrate (III), and C) subjecting the aluminum material having undergone the treatment of said step B to a treatment of immersion in a bath containing at least one metal salt selected from the group consisting of salts of Fe, Ni, Co, Cu, Zn, Cd, Ba, Tl, and Mg and at least one electrolyte selected as an additive from the group consisting of sodium sulfate, potassium sulfate, sodium chloride, and potassium chloride.

In this method, various colors can be imparted to the surface of the aluminum material by performing integral color anodizing for the formation of a colored anodic oxide coating in said step A) of the anodic oxidation or electrolytic coloring in an electrolytic solution containing a metal salt subsequently to said step A) of the anodic oxidation and subjecting the resultant colored anodic oxide coating to said treatment of electrophoresis of said step B) and to said treatment of immersion of said step C).

These and many other advantages, features and the further objects of the present invention will become apparent to those skilled in the art upon making reference to the following detailed description.

DETAILED DESCRIPTION OF THE INVENTION

Now, this invention will be described in detail below. First, an aluminum material is subjected to an anodic oxidation in conformity with the conventional method, to form an anodic oxide coating on the surface thereof. The anodic oxidation is well known to persons of ordinary skill in the art and will be omitted from the present description of this invention.

Then, the anodized aluminum material is immersed in a weakly acidic aqueous solution of a pH value of not more than 8 containing hexacyanoferrate (II) or hexacyanoferrate (III) such as potassium ferrocyanide, sodium ferrocyanide, potassium ferricyanide, sodium ferricyanide, ammonium ferrocyanide, and ammonium ferricyanide in a concentration from about 1 to about 60 g/liter, preferably from 5 to 20 g/liter and subjected to a treatment of electrophoresis by the application of a potential of from 1 to 20V with the aluminum material as an anode to cause adsorption of hexacyanoferrate (II) ions or hexacyanoferrate (III) ions on the receding walls of micropores of the anodic oxide coating on the aluminum material (Step B).

Subsequently, the aluminum material which has undergone said treatment of electrophoresis is subjected to a treatment of immersion for from about 0.5 to about 15 minutes in a weakly acidic aqueous solution containing at least one salt of a metal selected from the group consisting of Fe, Ni, Co, Cu, Zn, Cd, Ba, Tl, and Mg and at least one electrolyte selected as na additive from the group consisting of sodium sulfate, potassium sulfate, sodium chloride, and potassium chloride, severally in a concentration of from about 2 to about 50 g/liter (Step C).

By this treatment, the hexacyanoferrate (II) ion or hexacyanoferrate (III) ion deposited in consequence of the aforementioned treatment of electrophoresis on the receding walls of the micropores of the anodic oxide coating of the aluminum material is caused to react with the metallic ion of the aforementioned metal salt and consequently give rise to the metal compound of hexacyano iron (II) or hexacyano iron (III) on the receding walls of the micropores of the anodic oxide coating. As a result, a clear colored coating of a varying color indicated in Table 1 is obtained, depending on the metal salt added to the aqueous solution.

TABLE 1

| Ferrate component | Metal salt | Color produced |
|---|---|---|
| Potassium hexacyano-ferrate (II) | Ammonium oxalate | Light blue - blue |
| | Iron (III) nitrate | Light yellow - purple |
| | Copper nitrate | Light brown - pink |
| | Cobalt nitrate | Grayish green |
| | Barium sulfate | Light yellow |
| | Thallium sulfate | Yellow |
| Potassum hexacyano-ferrate (III) | Cobalt sulfate | Light brown |
| | Magnesium sulfate | Light brown |

As a component for the bath to be used for the treatment of immersion, the salts of $Ni^{2+}$, $Zn^{2+}$, and $Cd^{2+}$ are usable as effectively as those mentioned above.

Figure 1:
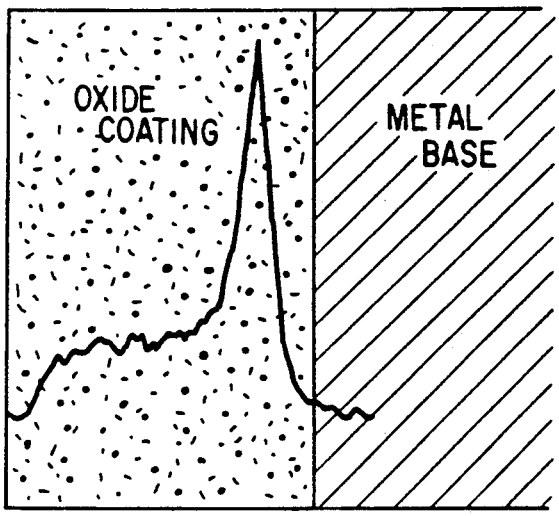
FIG. 1 is an EPMA diagram showing the distribution of iron contained in a coloring compound in a colored anodic oxide coating of an aluminum material undergone a coloring treatment according to this invention.
Figure 2:
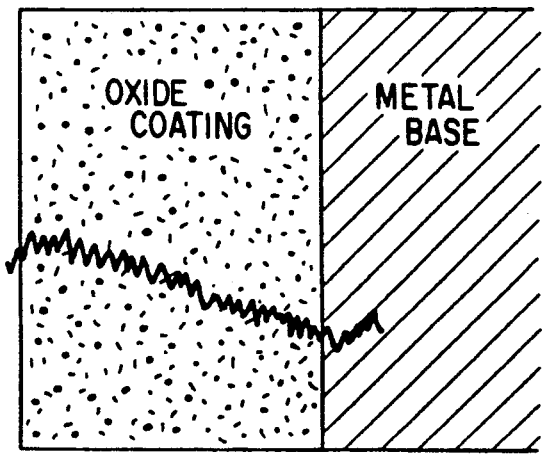
FIG. 2 is an EPMA diagram showing the distribution of iron contained in a coloring compound in a colored anodic oxide coating obtained when the coloring compound is formed without a treatment of electrophoresis.

The effect or action of the treatment of electrophoresis according to this invention will be described below with reference to the accompanying drawing. FIG. 2 represents a curve (of the data obtained by EPMA analysis) of distribution of iron contained in the colored reaction product in an anodic oxide coating obtained in said coloration treatment without undergoing the treatment of electrophoresis and FIG. 1 a curve of distribution of iron contained in the colored reaction product in an anodic oxide coating obtained in consequence of the treatment of electrophoresis of this invention. It is clearly noted from these EPMA diagrams that in the colored oxide coating shown in FIG. 1, the iron of the coloring compound is concentrically distributed in the receding parts of micropores in the anodic oxide coating. This fact clearly indicates that the hexacyanoferrate (II) ion or hexacyanoferrate (III) ion is deposited by the electrophoresis in the receding parts of micropores of the anodic oxide coating and this deposited ion is reacted on by the aforementioned metal salt to give rise to the colored reaction product [the metal compound of hexacyano iron (II) or (III)].

Further, in this invention, an electrolyte selected from among sodium sulfate, potassium sulfate, sodium chloride, and potassium chloride is added besides the aforementioned metal salt to the bath used for the aforementioned treatment of immersion (C) for the purpose of enhancing the deposition of the coloring compound in the receding parts of micropores of the anodic oxide coating. That is, the addition of the electrolyte to the bath for the treatment of immersion results in the highly satisfactory deposition of the coloring compound in the receding parts of micropores of the anodic oxide coating because the added electrolyte conspicuously enhances the effect of repressing or preventing the phenomenon of liberation of the coloring compound during the treatment of coloration, the treatment of washing with water, or the treatment of sealing the micropores.

In the method for coloration in accordance with the present invention, the coloration proceeds quickly and uniformly in high density because the deposition of the hexacyanoferrate (II) or (III) ion within the micropores of the anodic oxide coating by the treatment of electrophoresis can be controlled by an applying potential and the treatment time, and the deposited ion in the micropores is prevented liberating from the micropores. Further, the fact that the coloring compound is formed in the receding parts of micropores of the anodic oxide coating is effective in ensuring retention of the practical durability of the colored aluminum material.

Then, a sample aluminum material colored by the method of this invention and further covered with an electrically deposited acrylic type coating was tested for surface quality. The results are shown in Table 2. The data obtained by this test, indicate that the sample possessed satisfactory durability.

TABLE 2

| Item of test | Anodic oxide coating[1)] | Composite coating[2)] |
|---|---|---|
| Thickness of coating (μm) | | |
| Anodic oxide coating | 11 | 11 |
| Applied coating | — | 8 |
| Resistance to alkali[3)] | — | 10 hours, minimum RN 9.5 |

TABLE 2-continued

| Item of test | Anodic oxide coating[1] | Composite coating[2] |
|---|---|---|
| Resistance to acid[4] | — | 24 hours, minimum RN 9.5 |
| CASS corrosion resistance[5] | 8 hours, minimum RN 9 | 24 hours, minimum RN 9.5 |
| Accelerated weatherability[6] | — | No discoloration Minimum gloss retention ratio 95% |

[1]The method of Japanese Industrial Standard (JIS) H 8601 was followed with the necessary modifications.
[2]The method of JIS H 8602 was followed with the necessary modifications.
[3]Ring contact in 0.5% NaOH
[4]Ring contact in 5% HCl
[5]Sprayed at 50° C. with a salt solution containing 4% NaCl and 0.26 g of $CuCl_2$ per liter and adjusted to acidity of pH 3 by addition of acetic acid.
[6]Tested for 250 hours with a Sunshine Weathermeter, using intermitted spray of pure water at 63° C. for 12 minutes per 60 minutes.
RN = Rating number The aluminum materials furnished with various colors can be obtained by subjecting a given aluminum material to a treatment for integral color anodizing in the place of the ordinary treatment for anodic oxidation thereby forming a colored anodic oxide coating on the aluminum material or subjecting an aluminum material already undergone the treatment of anodic oxidation to a treatment of electrolytic coloring by AC electrolysis in a metal salt-containing electrolytic bath and thereafter performing on the colored oxide coated aluminum material the treatments of coloration, i.e. the treatment of electrophoresis (Step B) and the treatment of immersion (Step C) contemplated by this invention.

In accordance with the method of integral color anodizing, for example, a beautiful bluish gray aluminum material is produced from a silicon-containing aluminum material by subjecting the silicon-containing aluminum material to the treatment of integral color anodizing thereby imparting gray color to the aluminum material and then subjecting the gray-colored aluminum material to the electrophoresis treatment in a hexacyanoferrate (II) bath and the immersion treatment in a bath containing ferric oxalate and sodium sulfate.

Then, in accordance with the method of electrolytic coloring, a bright yellowish green aluminum material is produced by subjecting the anodized aluminum material to AC electrolytic coloring in an acidic aqueous solution containing a tin salt as a main component thereby imparting a color of yellowish gold to the oxide coating of the aluminum material and subsequently performing the aluminum material colored in yellowish gold the electrophoresis treatment in a hexacyanoferrate (II) bath and the immersion treatment in a bath containing ferric oxalate and sodium sulfate.

The treatment of integral color anodizing and the treatment of electrolytic coloring mentioned above can be effected by various well-known methods. These treatments are well known to persons of ordinary skill in the art and will be omitted from the present detailed description.

The colored aluminum material obtained by the treatment of coloration in accordance with this invention as described above may be subjected to a treatment of coating, such as dipping coating and electrodeposition coating, after performing or without performing a treatment of sealing micropores by various well-known methods such as washing with hot pure water, sealing with pressurized steam, and sealing with chemicals.

Now, this invention will be described more specifically below with reference to working examples, which are intended to be merely illustrative of and not in any sense limitative of the invention.

EXAMPLE 1

A rolled aluminum material (6063S) was subjected to anodic oxidation with direct current in an aqueous solution containing sulfuric acid in a concentration of 190 g/liter and kept at 20° C., to form an oxide coating 11 μm in thickness thereon. The anodized aluminum material was then immersed in an aqueous solution of a pH value of 2 containing potassium ferrocyanide in a concentration of 10 g/liter opposed as an anode to a counter electrode of carbon as a cathode, and subjected to a treatment of electrophoresis for five minutes with a potential of 5V. Then, the aluminum material was immersed in an aqueous solution containing ammonium iron oxalate in a concentration of 10 g/liter and sodium sulfate in a concentration of 10 g/liter, to obtain a bright blue coating thereon.

EXAMPLE 2

A rolled aluminum material undergone the treatment of electrophoresis described in Example 1 was immersed for five minutes in an aqueous solution of a pH value of 4.5 containing ammonium iron oxalate in a concentration of 20 g/liter and sodium sulfate in a concentration of 20 g/liter and kept at a bath temperature of 45° C., to obtain a coating colored in green.

EXAMPLE 3

An aluminum material (6063S) was subjected to anodic oxidation with direct current in an aqueous solution containing sulfuric acid in a concentration of 190 g/liter and kept at 20° C., to form an oxide coating 11 μm in thickness. The anodized aluminum material was subjected to a treatment of electrolysis for five minutes with an AC potential of 12V in a bath containing nickel sulfate in a concentration of 30 g/liter and boric acid in a concentration of 30 g/liter. Consequently, there was obtained an aluminum material having the color of bronze. When this material was subjected to the same coloration treatment as in Example 1, it was colored in grayish blue.

EXAMPLE 4

An aluminum material (6063S) was subjected to anodic oxidation with direct current in an aqueous solution containing sulfuric acid in a concentration of 190 g/liter and kept at 20° C., to form an oxide coating 11 μm in thickness thereon. The anodized aluminum material was subjected to a treatment of electrolysis for four minutes with an AC potential of 12V in an aqueous solution containing tin sulfate in a concentration of 6 g/liter, sulfuric acid in a concentration of 40 g/liter, ammonium sulfate in a concentration of 40 g/liter, formalin in a concentration of 3 g/liter, and ferrous sulfate in a concentration of 3 g/liter and kept at 25° C., to obtain an aluminum material having the color of yellowish gold. This treated material was subjected to the same coloration treatment as in Example 1, to obtain an aluminum material colored uniformly in green.

EXAMPLE 5

An aluminum material undergone the treatment of electrophoresis described in Example 1 was immersed for two minutes in a bath containing cobalt sulfate in a concentration of 20 g/liter and sodium sulfate in a concentration of 10 g/liter, to obtain a light grayish green coating thereon.

EXAMPLE 6

An aluminum material undergone the treatment of electrophoresis described in Example 1 was immersed for one minute in an aqueous solution of a pH value of 2 containing iron (III) sulfate in a concentration of 30 g/liter and sodium sulfate in a concentration of 10 g/liter, to obtain a coating colored in purple.

What we claim is:

1. A method of coloring an aluminum or aluminum alloy material, comprising the steps of:

A) subjecting said aluminum or aluminum alloy material to anodic oxidation thereby forming an anodic oxide coating on the surface thereof, B) subjecting said anodized aluminum or aluminum alloy material to a treatment for electrophoresis in a bath containing a hexacyanoferrate (II) or hexacyanoferrate (III), and C) subjecting said aluminum or aluminum alloy material undergone said treatment of electrophoresis to a treatment of immersion in a bath containing at least one metal salt selected from the group consisting of salts of Fe, Ni, Co, Cu, Zn, Cd, Ba, Tl, and Mg and at least one electrolyte selected as an additive from the group consisting of sodium sulfate, potassium sulfate, sodium chloride, and potassium chloride.

2. The method according to claim 1, wherein a colored anodic oxide coating is formed on the surface of said aluminum or aluminum alloy material in said step (A) of anodic oxidation.

3. The method according to claim 1, wherein said aluminum or aluminum alloy material undergone said step (A) of anodic oxidation is subjected to AC electrolysis in an electrolytic solution containing a metal salt to effect coloration of the anodic oxide coating and the resultant colored aluminum or aluminum alloy material is subjected to said treatment of electrophoresis (B) and said treatment of immersion (C).

4. The method according to claim 1, wherein said treatment of electrophoresis (B) is effected by placing said aluminum or aluminum alloy material in an aqueous solution of a pH value of not more than 8 containing a hexacyanoferrate (II) or hexacyanoferrate (III) in a concentration in the range of 1 to 60 g/liter and applying a potential of from 1 to 20V to said aluminum or aluminum alloy material as an anode.

5. The method according to claim 4, wherein said hexacyanoferrate is potassium ferrocyanide or potassium ferricyanide.

6. The method according to claim 1, wherein said treatment of immersion (C) is effected by immersing said aluminum or aluminum alloy material for 0.5 to 15 minutes in a weakly acidic aqueous solution containing said metal salt and said electrolyte severally in a concentration of from 2 to 50 g/liter.

* * * * *